US006811386B2

(12) United States Patent
Hedington et al.

(10) Patent No.: US 6,811,386 B2
(45) Date of Patent: Nov. 2, 2004

(54) PERISTALTIC PUMP WITH PREFORMED TUBE

(75) Inventors: John Graham Hedington, Halstead (GB); Stuart Richard Page, Halstead (GB)

(73) Assignee: Constance Limited (GB)

( * ) Notice: Subject to any disclaimer, the term of this patent is extended or adjusted under 35 U.S.C. 154(b) by 0 days.

(21) Appl. No.: 10/296,517

(22) PCT Filed: May 25, 2001

(86) PCT No.: PCT/GB01/02317

§ 371 (c)(1),
(2), (4) Date: Nov. 25, 2002

(87) PCT Pub. No.: WO01/92725

PCT Pub. Date: Dec. 6, 2001

(65) Prior Publication Data

US 2003/0190245 A1 Oct. 9, 2003

(30) Foreign Application Priority Data

May 26, 2000 (GB) ..... 0012930/4

(51) Int. Cl.[7] ..... F04B 43/08; A61M 1/00

(52) U.S. Cl. ..... 417/477.5; 417/474; 417/476; 417/477.3; 417/477.12; 604/153

(58) Field of Search ..... 417/474, 476, 417/447.1, 477.6, 477.3, 477.5, 477.12; 604/151, 153

(56) References Cited

U.S. PATENT DOCUMENTS

| | | | | | |
|---|---|---|---|---|---|
| 401,950 | A | * | 4/1889 | Haussamm | 604/214 |
| 922,205 | A | * | 5/1909 | Still | 417/61 |
| 2,865,537 | A | * | 12/1958 | Jackson | 222/214 |
| 3,669,578 | A | * | 6/1972 | Nameny | 418/45 |
| 3,749,531 | A | * | 7/1973 | Walker et al. | 418/45 |
| 3,955,902 | A | * | 5/1976 | Kyvsgaard | 417/477.3 |
| 4,201,525 | A | * | 5/1980 | Brown et al. | 417/477.5 |
| 4,205,948 | A | * | 6/1980 | Jones | 417/477.6 |
| 4,392,794 | A | * | 7/1983 | Foxcroft | 417/475 |
| 4,421,506 | A | * | 12/1983 | Danby et al. | 604/250 |
| 4,494,285 | A | * | 1/1985 | O'Boyle | 29/888.022 |

FOREIGN PATENT DOCUMENTS

| | | | | |
|---|---|---|---|---|
| DE | 24 33 145 | * | 1/1976 | F01C/5/08 |
| FR | 2 473 129 | * | 7/1981 | F04B/43/12 |
| FR | 2 604 362 | * | 4/1988 | A61M/1/10 |

* cited by examiner

*Primary Examiner*—Justine R. Yu
*Assistant Examiner*—Timothy P. Solak
(74) *Attorney, Agent, or Firm*—McGarry Bair PC

(57) ABSTRACT

A peristaltic pump mechanism comprises a base plate (11) having a generally planar surface for supporting a pump tube (12) to extend at least partially around a circular path defined on said surface, an operating section (10) connectable to the base member (11). At least one rotatable pumping element (21) is mounted on the operating section (10) locally to compress the pump tube (12) and roll around the circular path when the operating section (10) is connected to the base member. A power drive causes the pumping element (21) to roll around the circular path, the pumping element (21) being of conical shape and mounted on the operating section (10) so that the axis of the element is substantially co-incident with the centre of the circular path. In this way essentially no slippage takes place between the pumping element and the base plate.

16 Claims, 4 Drawing Sheets

FIG 1
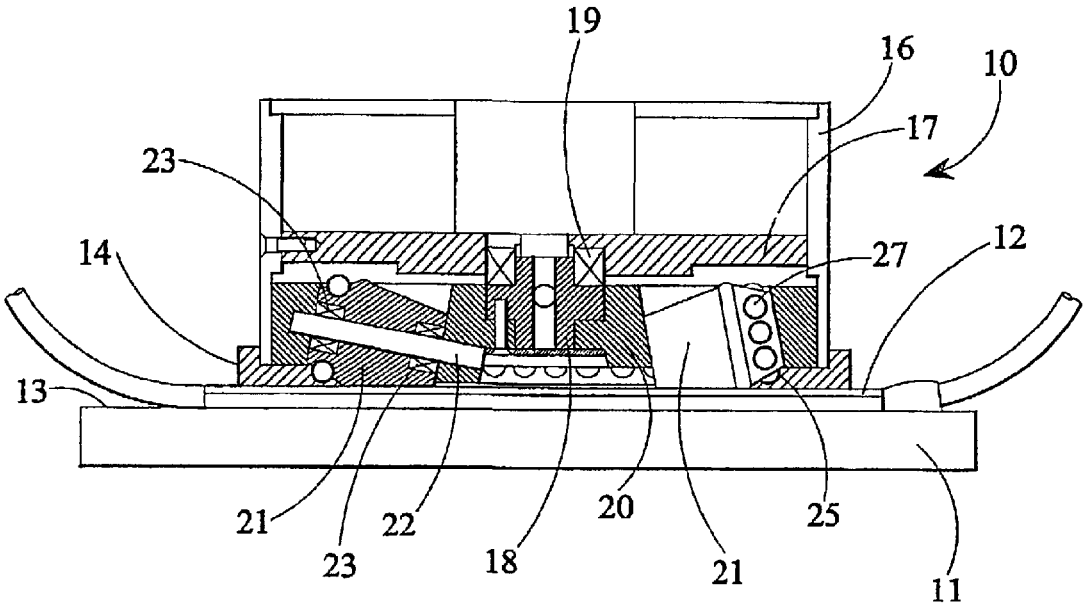
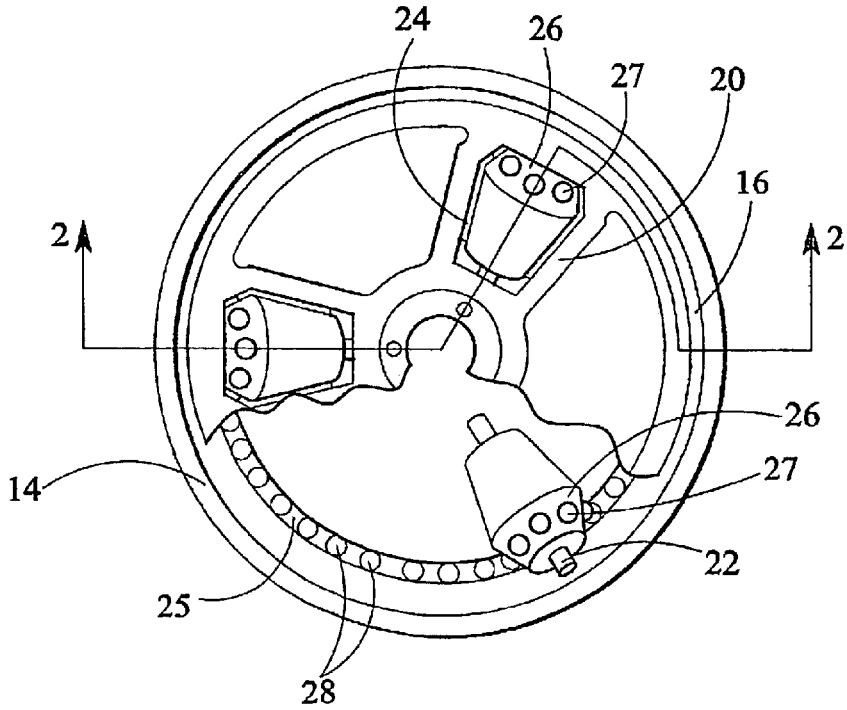
FIG 2

FIG 3
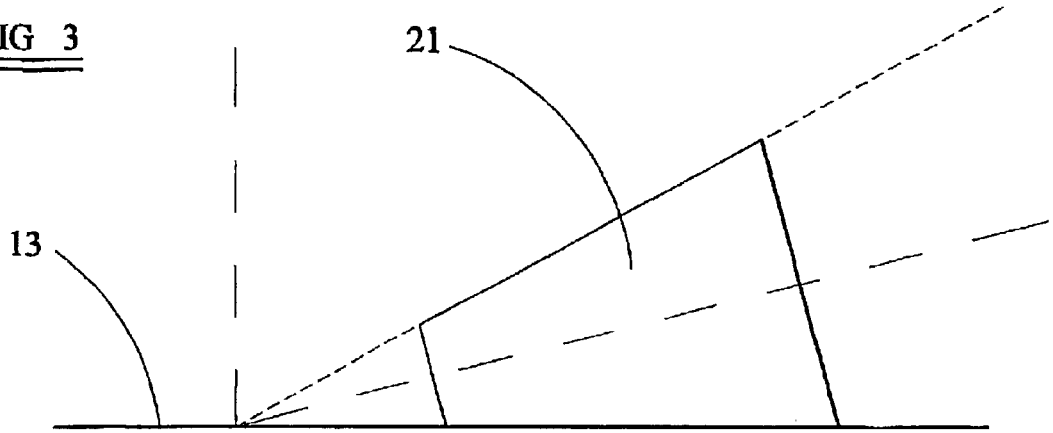
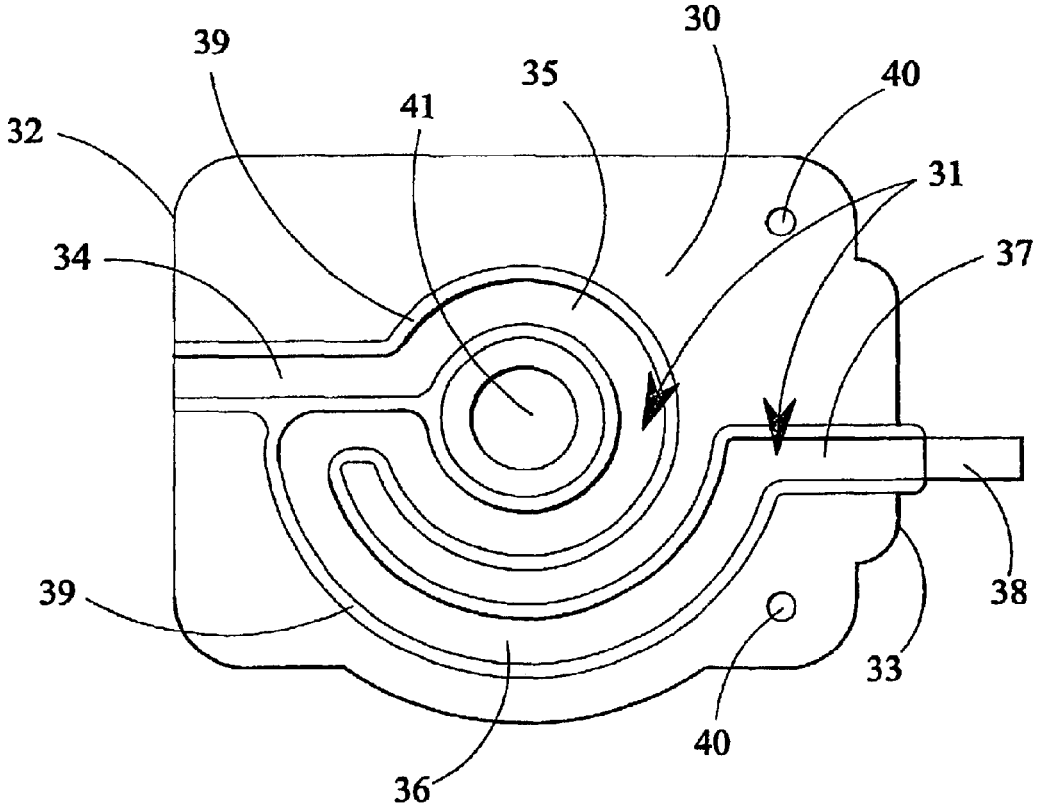
FIG 4

PERISTALTIC PUMP WITH PREFORMED TUBE

CROSS-REFERENCE TO RELATED APPLICATIONS

This application claims priority on International Application No. PCT/GB01/02317, filed May 25, 2001, which claims priority on British Application No. 0129340.4, filed May 26, 2000.

BACKGROUND OF THE INVENTION

This invention relates to a peristaltic pump mechanism.

Peristaltic pumps are widely used in many industries, but particularly in the medical industry for pumping of body fluids or fluids to be received by a patient, since there is no need to provide any valves, which could possibly leak, nor is there any contamination of the liquid to be pumped since the liquid is not contacted by component parts of the pump, lubricants used in the pump and so on. In a peristaltic pump, the liquid to be pumped passes through a flexible tube which is compressed by at least one roller, arranged to run along the length of the tube. The roller serves to close the tube and so isolate at the point of compression liquid downstream the tube from liquid upstream the tube. Then, on moving the roller along the tube, the liquid downstream the tube is driven further downstream, and so is pumped by the roller.

A typical peristaltic pump has a static flexible tube arranged in a part-circular form around the periphery of a pump wheel which carries a plurality of arcuately-spaced rollers and each of which engages and compresses the tube. To ensure a sufficient compression of the tube, a sleeve usually surrounds the outer periphery of the tube so that the compression takes place between the roller and the inner surface of the sleeve. Then, on rotation of the pump wheel, liquid will be pumped around the tube in the direction of rotation of the wheel, and by having a plurality of rollers so that at least two rollers are at all times engaged with, and compress, the tube, back-leakage is prevented.

With the configuration of peristaltic pump described above, there is no slippage between the rollers on the wheel and the tube. Thus, the pump may be expected to have a long working life with only minimal wear of the tube, as the rollers run around the tube. The tube may thus form part of some other equipment and is located within the sleeve for pumping as the wheel rotates, whenever a liquid associated with the equipment is to be pumped. However, location of the tube between the pump sleeve and the rollers can be difficult to achieve and there is the likelihood of the tube being damaged.

The alternative is to provide the flexible tube as a part of the pump, in which case connections must be made to each end of the flexible tube, whenever a liquid is to be pumped, and this leads to the possibility of foreign matter entering the tube when the pump is disconnected from the equipment. Further, contamination may occur on making the connections, or following a previous use of the pump, for pumping a different liquid.

A principal aim of the present invention is to provide a peristaltic pump mechanism which allows the connection of the mechanism to a flexible tube through which a liquid is to be pumped in a particularly simple manner, without compromising the efficacy of the pump and the advantages of a peristaltic pump.

SUMMARY OF THE INVENTION

According to the present invention, there is provided a peristaltic pump mechanism comprising a base plate having a generally planar surface on which is defined a circular path, the planar surface being adapted for supporting sheets of flexible plastic between which is defined a part-circular pump tube whereby the pump tube will extend partially around said circular path when said sheets are supported on said surface, an operating section, a hinge connecting the operating section to the base plate so as to be movable between an open position where the sheets of plastic may be positioned on the planar surface of the base plate with said pump tube aligned with the circular path and a pumping position where the operating section overlies said planar surface, a releasable catch mechanism adapted to hold the operating section in said pumping position, three like rotatable pumping elements arranged with their axes substantially at 120° to each other and mounted on the operating section locally to compress said pump tube and to roll around the circular path of the base plate when the operating section is in its pumping position, each said pumping element being of conical shape and mounted on the operating section so that the axis of the element is substantially co-incident with the center of the circular path in the plane of the planar surface whereby essentially no slippage takes place between the conical surface of each pumping element and the flexible sheets supported on the planar surface of the base plate, and power drive means to cause the pumping elements to roll around the circular path.

It will be appreciated that with the present invention, the flexible pump tube is constrained to lie on a generally planar surface and the pump elements roll around the tube, on that planar surface. Friction, and so wear of the tube, is avoided by providing pump elements of an appropriate conical form and mounted such that essentially no slippage takes place between the tube and the pump elements.

There are three pumping elements arranged with their respective axes angularly equi-spaced around the circular path and all driven for simultaneous movement around that path. In this way, back leakage through the pump may be avoided, since the tube will be closed off by compression at all times, by at least one of the pump elements.

Further to ensure that no slippage occurs between the pump elements and the pump tube, each pump element is preferably provided with gearing arranged to cause the pump element to rotate without slippage with respect to the base plate.

So as to facilitate separation of the operating section and the base plate, and to facilitate connection together of those components, it is preferred that the operating section is pivoted to the base plate, a catch arrangement being provided to hold the operating section in its "closed" position parallel to the base plate. Means may be provided to permit pre-setting of the gap between the upper surface of the base plate and the plane of the lower surfaces of the pumping elements, so as to allow proper accommodation of the pump tube. In the alternative, one of the components may be spring-loaded, whereby the spring force allows accommodation of the pump tube, for compression by each pumping element.

The pump tube preferably is configured to facilitate its incorporation within the pump mechanism. Advantageously, the pump tube is formed integrally with a sheet of flexible plastics material and the base plate and operating section have co-operating means to locate the sheet in a pre-defined position on the base plate. For example, such means may comprise at least one pin mounted on either the base plate or the operating section, so as to project the other component, and then be received in a recess in the other component when the two components are joined together. The sheet of flexible material may then have an appropriately positioned aperture for each pin, whereby the sheet is positively located with respect to the base sheet.

This invention extends to a peristaltic pump of this invention as described above in combination with a peristaltic tube component arranged to deliver liquid in a controlled manner to some other site, which component comprises a pair of overlying flexible sheets bonded together to define a tube-like passageway therebetween and which extends from one common edge of the sheets to another common edge of the sheets, a portion of the passageway intermediate the ends thereof being of part-circular shape for compression by a pump member rolling around a circular path coincident with said portion of the passageway of part-circular shape when the component is mounted on a peristaltic pump, the ends of the passageway being configured to permit the connection thereto of ducts for the transfer of liquid to and from the passageway, and the sheets being profiled and adapted to permit the connection thereto of a peristaltic pump device co-operable with the tube-like passageway to control the flow of liquid through the passageway.

BRIEF DESCRIPTION OF THE DRAWINGS

By way of example only, one specific embodiment of peristaltic pump constructed and arranged in accordance with the present invention will now be described in detail, with reference being made to the accompanying drawings in which:

FIG. 1 is a plan view on the embodiment of pump mechanism, partially cut away for clarity;

FIG. 2 is a section through the pump mechanism, taken on line 2—2 marked on FIG. 1;

FIG. 3 diagrammatically illustrates the principle of the conical pump element;

FIG. 4 shows a flexible tube for use with the pump mechanism of FIGS. 1 and 2;

DETAILED DESCRIPTION OF THE INVENTION

Figure 5:
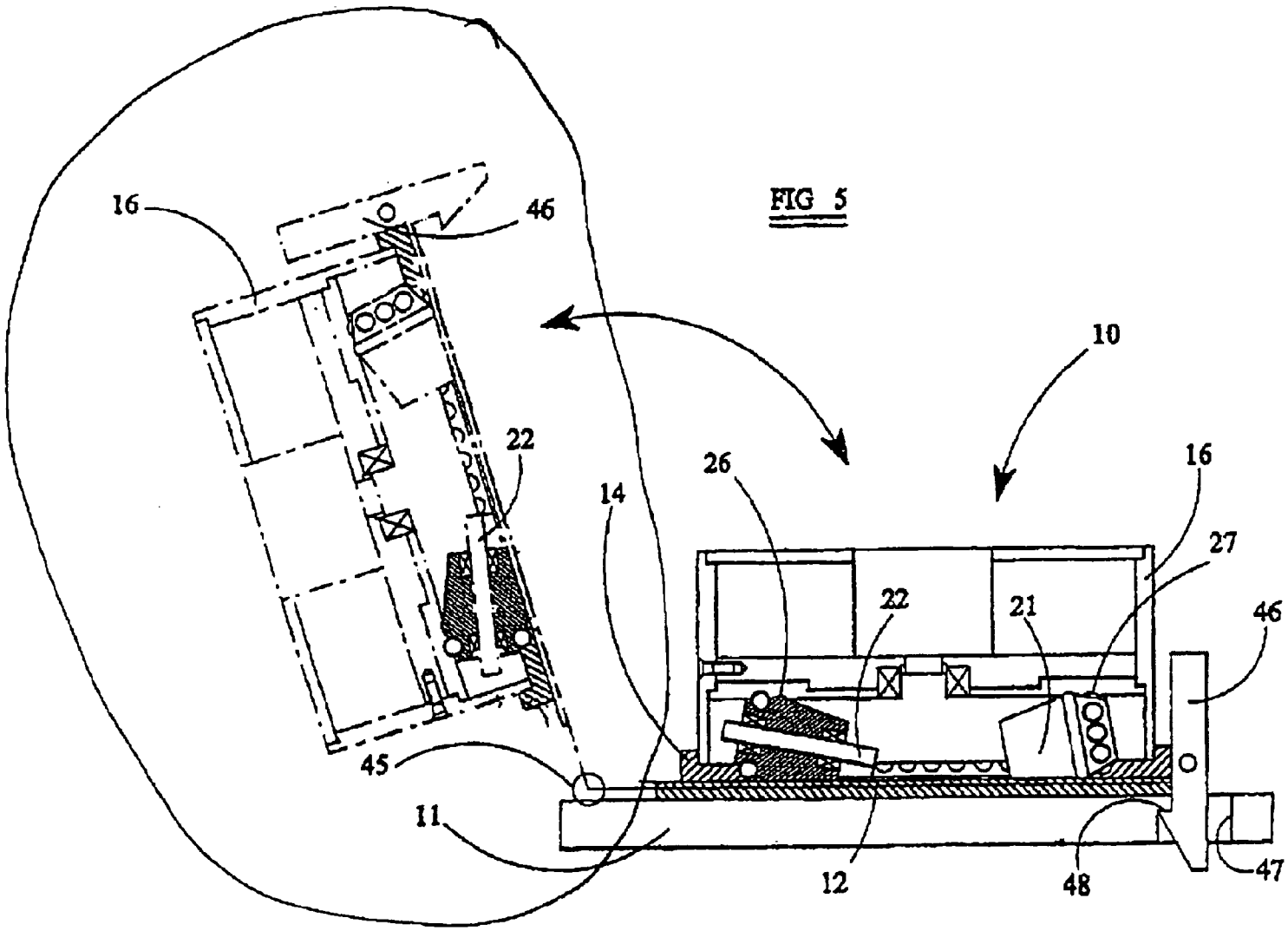
FIG. 5 shows the pump mechanism of FIGS. 1 to 4, but with the addition of a hinge connection.

Though in the following description references are made to "upper", "lower" and so on, that is expressly with reference to FIG. 1. Usually, the pump would be used with the pump axis horizonal, but the pump mechanism may be employed in any required disposition having regard to the intended use of the pump mechanism and the mechanism is not to be regarded as limited by the terms "upper" and so on. Referring to the drawings, the peristaltic pump mechanism comprises an operating section 10 which connects to a base plate 11, with a peristaltic flexible pump tube 12 located on the base plate and on which the operating section acts. The base plate 11 defines a planar upper surface 13 which serves to support the tube 12, the operating section 10 connecting to the base plate for example by external clips (not shown in FIG. 1), which embrace both the base plate and a flange 14 provided on the operating section.

The operating section has a main body defined by a cylindrical sleeve 16 within which is mounted a circular wall 17. A hub 18 is rotatably mounted on that wall 17 by means of a ball-race 19, the hub being connected to a spider 20 which is a close rotational fit within the sleeve 16, and rotatably supports three pump members 21 each having a frusto-conical pump surface. If desired, the spider 20 with its pump member 21 may be designed as a disposable element. Each pump member is rotatably mounted on a respective shaft 22 by means of the two ball-races 23, the two ends of each shaft 22 being carried in inner and outer portions of the spider with the pump member located in an aperture 24 in the spider.

Each shaft 22 extends at an angle of approximately 15° to the radial plane of the sleeve 16 and the principal outer surface of each pump member 21 is of conical form, lying at the same 15° angle to the axis of the member. Thus, a generator of the frusto-conical surface at the lowermost part of each member 21 lies in a first common radial plane, as best seen in FIG. 1. It will be seen that the cone angle of the illustrated pump member 21 is 30°. It is, however, preferable to use a larger cone angle, and the cone angle is preferably 45° to 75°, more preferably 50° to 70°, still more preferably 55° to 65°, and most preferably substantially 60°.

The flange 14 is connected to the lower end of the sleeve 16 and extends inwardly of the sleeve, to provide a running surface 25 for end portions 26 of the pump members 21. Those end portions 26 are also of frusto-conical form and lie at the same 15° angle as the principal outer surface of each pump member, but in the opposite sense whereby a generator of each end portion 26 at the uppermost part of each member 21 lies in a second common radial plane. Each end portion 26 carries a plurality of equi-spaced part-spherical projections 27, the running surface 25 of flange 14 having a plurality of similarly equi-spaced recesses 28 on a common pitch circle and engaged by the projections 27 of the members 21. Thus, rotation of the spider 20 causes the pump members 21 to rotate about their respective axes, by the inter-engagement of the projections 27 with the recesses 28 of the flange 14. The projections 27 and recesses 28 thus act as teeth meshing with one another. Other designs of gearing than that shown in the drawings could instead be employed.

The configuration of the spider 20, flange 14 and the pump members 21 with the gearing is such that the axis of rotation of each pump member intersects the axis of rotation of the spider at or slightly spaced from the first common plane, in the direction away from the wall 17, as best appreciated from FIG. 3. In this way, the rotation of each pump member about its axis will occur without any slippage between the outer conical surface of the pump member and the first common plane, and so in effect without slippage between the outer conical surface and the planar upper surface of the base plate 11, once the operating section 10 has been connected to the base plate 11.

Mounted within the sleeve 16 above the wall 17 is an electric motor drive assembly, for the spider 20. This assembly includes a speed control unit as well as a gear box to reduce the output speed of the drive motor, whereby the spider 20 may be rotated about the axis of the sleeve at a desired and controlled rate.

FIG. 4 shows a flexible peristaltic pump tube suitable for use with the pump mechanism of FIGS. 1 and 2. This tube comprises two similarly shaped sheets 30 of flexible plastics material (such as polyethylene) overlying each other and bonded together, for example by heat-fusion, so as to define a flexible tube 31 therebetween. This tube extends from one edge 32 of the sheets to an opposed edge 33, the tube defining from edge 32 a linear portion 34 which runs into a C-shaped portion 35. The further end of the C-shaped portion doubles back on itself to form an arcuate portion 36, which then runs into a further linear portion 37 leading to opposed edge 33. A spigot 38 is fused to the sheets 30, in communication with the linear portion 37, to permit the connection thereto of a pipe for pumped fluid.

Though the two sheets are bonded together over their overlying areas, other than where the tube 31 is formed, that tube may be defined by reinforced areas 39, in order to minimise the likelihood of leakage out of the tube.

The two sheets 30 have a pair of apertures 40 formed therein remote from the tube 31, for receiving pins (not shown) projecting from the base plate 11 of the pump mechanism. Further, there is a central aperture 41 through the sheets, concentric with C-shaped portion 35. Thus, location of the sheets 30 on the base section with the pins projecting through the apertures 40 positions the tube 31 in a fixed and positively defined relationship, with respect to the operating section when also connected to the base plate. In this position, the circular path followed by the operating members 21 overlies the C-shaped portion 35, of the flexible tube 31, whereby a peristaltic pump is formed between the base plate and the operating members 21, the C-shaped portion of the tube being compressed therebetween.

In use, the flexible tube 31 together with the sheets 30 may be formed as a part of some other item or equipment—for example, a bag containing a fluid to be introduced or intravenously or otherwise into a patient. Positive delivery of the liquid from the bag at a precisely controlled rate may be achieved by connecting to the sheets the peristaltic mechanism and then operating the pump at a predetermined and controlled rate. Further, the members 21 always create two shut-off points for fluid-flow through the flexible tube 31, and so prevent free-flow, siphonage or reverse pressure through the tube. In addition, however, the tube 31 may be provided at the downstream end with a self-sealing closure, and the pump may be provided with means for opening the closure when the tube is in position in the pump. Particularly suitable bags for use with this pump are decribed in our International patent application filed on even date herewith under the title "Fluid Bags", claiming priority from UK patent application No. 0012931.2.

Figure 6:
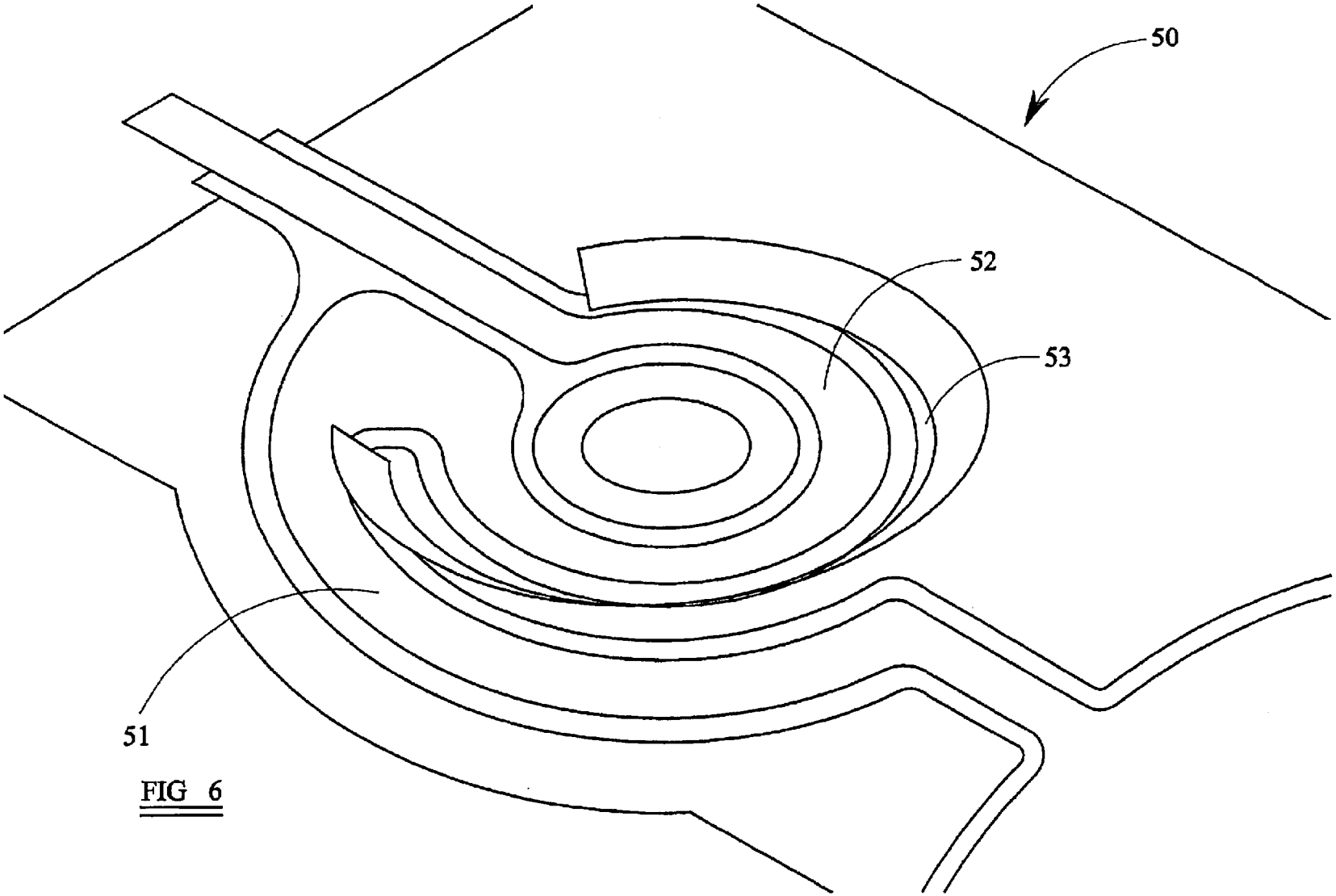
FIG. 6 shows part of a bag, for use with the pump mechanism, and a spring for flattening the bag.

It may be desirable to provide the pump mechanism with means for flattening that portion of a bag with which the pump members are to engage. FIG. 6 shows part of a bag 50 defining a tube 51, with a C-shaped tube portion 52 to be engaged by the pump members. A part frusto-conical spring 53 surrounds the tube portion 52. A force is applied to the spring 53 by the operating section 10 of the pump mechanism to urge the spring against the bag 50. Because of its frusto-conical shape this causes the spring not only to push down on the bag but also to exert a force radially outwards. This puts the region of the bag surrounded by the spring into tension, thus flattening it.

Though not shown in the drawings, means may be provided to permit adjustment of the spacing between the first common radial plane referred to above (i.e. the plane of lowermost parts of the members 21) and the upper surface 13 of the base plate 11. This allows thinner or thicker pump tubes to be accommodated, whilst still giving compression of the tube to permit pumping. In addition, the operating section 10 may be mounted with respect to the base plate 11 via a universal joint, so that the above mentioned first common radial plane can easily be made to be parallel to the surface 13, without tight tolerances having to be maintained in manufacture of the pump.

FIG. 5 shows in simplified outline the pump of FIG. 1 together with a base-plate 11, and like parts are given like reference numbers. Also shown in FIG. 5 is a hinged connection 45 between the operating section 10 and the base plate, together with a catch member 46 pivoted to flange 14. This member 46 extends through an aperture 47 in the base plate to engage behind a shoulder 48 when the pump is closed. When the pump tube 31 is to be released, the catch member 46 is operated so freeing the operating section to pivot to the alternative position as shown in FIG. 5.

The pump mechanism has relatively few simple parts and so is easy to manufacture and assemble. The moving parts require relatively low power to operate, and so the unit can be driven by a battery, which may then have a relatively long life. When used in the medical industry, the pump mechanism may be reused many, many times, though each time with a new flexible tube 31 directly associated with the fluid to be pumped and which may be disposed of subsequently, so eliminating contamination.

What is claimed is:

1. A peristaltic pump mechanism comprising:

a base plate having a generally planar surface on which is defined a circular path, the planar surface being adapted for supporting sheets of flexible plastic between which is defined a part-circular pump tube whereby the pump tube will extend partially around said circular path when said sheets are supported on said surface;

an operating section;

a hinge connecting the operating section to the base plate so as to be moveable between an open position where the sheets of plastic may be positioned on the planar surface of the base plate with said pump tube aligned with the circular path and a pumping position where the operating section overlies said planar surface;

a releasable catch mechanism adapted to hold the operating section in said pumping position;

three like rotatable pumping elements arranged with their axes substantially at 120° to each other and mounted on the operating section locally to compress said pump tube and to roll around the circular path of the base plate when the operating section is in its pumping position, each said pumping element being of conical shape and mounted on the operating section so that the axis of the pumping element is substantially co-incident with the center of the circular path in the plane of the planar surface whereby essentially no slippage takes place between the conical surface of each pumping element and the flexible sheets supported on the planar surface of the base plate; and power drive means to cause the pumping elements to roll around the circular path.

2. A peristaltic pump as claimed in claim 1, wherein each pumping element is provided with teeth spaced around its conical surface, which teeth mesh with corresponding teeth formed in the base plate.

3. A peristaltic pump as claimed in claim 1, wherein the base plate and operating section have co-operating means to locate said sheet in a pre-defined position on the base plate.

4. A peristaltic pump as claimed in claim 3, wherein said co-operating means comprise at least one pin mounted to project from at least one of the surface of the base plate and the operating section and receivable in a recess in the other of the base plate and operating section, which pin passes through an aperture in the sheet of flexible material supported on the base plate so that the pump tube of the sheet is aligned with the circular path of the base plate.

5. A peristaltic pump as claimed in claim 3, wherein there are means for flattening the sheets of plastics in a region where the pump tube is to be compressed by the pumping element.

6. A peristaltic pump as claimed in claim 1, wherein the power drive means includes an electric motor drivingly coupled to each said pumping element.

7. A peristaltic pump as claimed in claim 6, wherein the operating speed of the motor is adjustable.

8. A peristaltic pump as claimed in claim 1, wherein the pumping element has a cone angle of from 45° to 75°.

9. A peristaltic pump as claimed in claim 8, wherein said cone angle is from 50° to 70°.

10. A peristaltic pump as claimed in claim 5, wherein said cone angle is from 55° to 65°.

11. A peristaltic pump as claimed in claim 8, wherein said cone angle is substantially 60°.

12. A peristaltic pump as claimed in claim 1 in combination with a peristaltic pump tube component arranged to deliver liquid in a controlled manner from a source to some other site, which component comprises a pair of overlying flexible sheets bonded together to define a tube-like passageway therebetween and which extends from one common edge of the sheets to another common edge of the sheets, a portion of the passageway intermediate the ends thereof being of pert-circular shape for compression by said three pumping elements of the pump rolling around said circular path coincident with said portion of the passageway of part-circular shape when the component is mounted on the base plate of the peristaltic pump, the ends of the passageway being configured to permit the connection thereto of duets for the transfer of liquid to and from the passageway, and the sheets being profiled and adapted to permit the connection thereto of the peristaltic pump device co-operable with the tube-like passageway to control the flow of liquid through the passageway.

13. The combination of claim 12, wherein the overlying flexible sheets are formed integrally with a reservoir for liquid to be pumped, one end of the passageway communicating with the reservoir and the other end of the passageway being formed with a connector for a duct to lead pumped liquid away from the overlying flexible sheets.

14. A peristaltic pump mechanism comprising:

a base plate having a generally planar surface on which is defined a circular path, the planar surface being adapted for supporting sheets of flexible plastic between which is defined a part-circular pump tube whereby the pump tube will extend partially around said circular path when said sheets are supported on said surface;

an operating section;

a hinge connecting the operating section to the base plate so as to be movable between an open position where the sheets of plastic may be positioned on the planar surface of the base plate with said pump tube aligned with the circular path and a pumping position where the operating section overlies said planar surface;

at least one pin mounted to project from at least one of the surfaces of the base plate and the operating section and receivable in a recess in the other of the base plate and operating section, which at least one pin passes through a corresponding aperture in the sheets of plastic supported on the base plate to locate said sheets in a predefined position, so that the pump tube of the sheets is aligned with the circular path of the base plate;

a releasable catch mechanism adapted to hold the operating section in said pumping position;

three like rotatable pumping elements arranged with their axes substantially at 12° to each other and mounted on the operating section locally to compress said pump tube to roll around the circular path of the base plate when the operating section is in its pumping position, each said pumping element being of conical shape and mounted on the operating section so that the axis of the pumping element is substantially co-incident with the center of the circular path in the plane of the planar surface whereby essentially no slippage takes place between the conical surface of each pumping element and the flexible sheets supported on the planar surface of the base plate; and power drive means to cause the pumping elements to roll around the circular path.

15. A peristaltic pump mechanism comprising:

a base plate having a generally planar surface on which is defined a circular path, the planar surface being adapted for supporting sheets of flexible plastic between which is defined a pert-circular pump tube whereby the pump tube will extend partially around said circular path when said sheets are supported on said surface;

an operating section;

said base plate and said operating section have co-operating means to locate said sheet in a pre-defined position on the base plate;

a hinge connecting the operating section to the base plate so as to be movable between an open position where the sheets of plastic may be positioned on the planar surface of the base plate with said pump tube aligned with the circular path and a pumping position where the operating section overlies said planar surface;

a releasable catch mechanism adapted to hold the operating section in said pumping position;

three rotatable pumping elements arranged with their axes substantially at 120° to each other and mounted on the operating section locally to compress said pump tube and to roll around the circular path of the base plate when the operating section is in its pumping position, each said pumping element being of conical shape and mounted on the operating section so that the axis of the pumping element is substantially co-incident with the center of the circular path in the plane of the planar surface whereby essentially no slippage takes place between the conical surface of each pumping element and the flexible sheets supported on the planar surface of the base plate;

power drive means to cause the pumping elements to roll around the circular path; and means for flattening the sheets of plastic in a region where the pump tube is to be compressed by the pumping element.

16. A peristaltic pump mechanism as claimed in claim 15, wherein said means for flattening comprises a part frusto-conical spring for disposition on supported sheets of plastic located between the base plate and the operating section so as partially to surround the part-circular pump tube defined by said sheets, so as to be engaged by the pumping elements.

* * * * *

UNITED STATES PATENT AND TRADEMARK OFFICE

CERTIFICATE OF CORRECTION

PATENT NO. : 6,811,386 B2 
DATED : November 2, 2004
INVENTOR(S) : John Graham Hedington and Stuart Richard Page It is certified that error appears in the above-identified patent and that said Letters Patent is hereby corrected as shown below:

Column 8,
Line 2, reads "substantially at 12°" should read -- substantially at 120° --
Line 21, reads "is defined a pert-circular pump" should read -- is defined a part-circular pump --

Signed and Sealed this

Seventeenth Day of May, 2005

JON W. DUDAS
*Director of the United States Patent and Trademark Office*